US006133885A

United States Patent [19]

Luniak et al.

[11] Patent Number: 6,133,885

[45] Date of Patent: Oct. 17, 2000

[54] NON-TELESCOPING ANTENNA ASSEMBLY FOR A WIRELESS COMMUNICATION DEVICE

[75] Inventors: Joseph H. Luniak, Mundelein; David W. Trahan, Grayslake, both of Ill.

[73] Assignee: Motorola, Inc., Schaumburg, Ill.

[21] Appl. No.: 09/185,364

[22] Filed: Nov. 3, 1998

[51] Int. Cl.[7] ..... H01Q 1/24

[52] U.S. Cl. ..... 343/702; 343/906

[58] Field of Search ..... 343/702, 906, 343/900, 715

[56] References Cited

U.S. PATENT DOCUMENTS

| | | | |
|---|---|---|---|
| 4,867,698 | 9/1989 | Griffiths | 439/317 |
| 5,079,558 | 1/1992 | Koike | 343/702 |
| 5,204,687 | 4/1993 | Elliott et al. | 343/702 |
| 5,343,213 | 8/1994 | Kottke et al. | 343/702 |
| 5,469,177 | 11/1995 | Rush et al. | 343/702 |
| 5,739,792 | 4/1998 | Hassemer et al. | 343/702 |
| 5,880,696 | 3/1999 | Koleda | 343/702 |
| 5,929,815 | 7/1999 | Elderfield | 343/702 |
| 5,949,379 | 9/1999 | Yang | 343/702 |
| 5,955,999 | 9/1999 | Mutz et al. | 343/895 |
| 5,986,608 | 11/1999 | Korisch et al. | 343/702 |
| 6,002,372 | 12/1999 | Sullivan | 343/702 |
| 6,011,516 | 1/2000 | Minegishi et al. | 343/702 |

OTHER PUBLICATIONS

Zhou, Guangping et al. "An Antenna Adapted to Operate in a Plurality of Frequency Bands", U.S.S.N. 09/032,162, attorney docket No. CE01643R, filed Feb. 27, 1998.

*Primary Examiner*—Hoanganh Le
*Assistant Examiner*—Trinh Vo Dinh
*Attorney, Agent, or Firm*—Mark D. Patrick; Hisashi D. Watanabe

[57] ABSTRACT

An antenna assembly (118) for a wireless communication device (100) has a non-telescoping antenna (200), a bushing (204) and a post (202). The bushing (204) has an attachment mechanism (238) to secure the bushing (204) to the device (100). The post (202) has two ends. One end of the post (202) is joined to the non-telescoping antenna (200). The other end of the post adapted to electrically connect the non-telescoping antenna (200) to transceiver circuitry (304) of the device (100). The post (202) is journaled in the bushing (204) to permit to permit radial movement of the non-telescoping antenna (200) without unsecuring the bushing (204) from the device (100).

9 Claims, 3 Drawing Sheets

NON-TELESCOPING ANTENNA ASSEMBLY FOR A WIRELESS COMMUNICATION DEVICE

FIELD OF THE INVENTION

The present invention relates to non-telescoping antennas for wireless communication devices.

BACKGROUND OF THE INVENTION

Most wireless communication devices, such as cellular radiotelephones, employ an antenna for radiating and receiving radio frequency (RF) signals. The antenna is typically carried on the external surface of the device. Because of its external location on the device, the antenna is subject to manipulation by a user of the device. While some of the antennas are telescoping antennas adapted for longitudinal movement by a user between stowed and extended positions, other antennas are non-telescoping antennas not meant for movement by the user. One such non-telescoping antenna, the stubby antenna, usually employs a threaded end that screws into a threaded receiving socket on the device, thereby, attaching the stubby antenna to the device. Detachment of the stubby antenna is accomplished by rotating the stubby antenna in a direction opposite to the direction it was rotated for attachment. Users of the device, inadvertently or otherwise, have a tendency to manipulate and detach such non-telescoping antennas. Unfortunately, repeated detachments can increase the risk of foreign material entering the device as well as strip the screw threads on the base of the antenna and/or in the receiving socket of the device.

Therefore, what is needed is an antenna assembly for a non-telescoping antenna that allows a user to manipulate the non-telescoping antenna without detaching it from the device.

DETAILED DESCRIPTION OF THE PREFERRED EMBODIMENTS

An antenna assembly for a wireless communication device has a non-telescoping antenna, a bushing and a post. The bushing has an attachment mechanism to secure the bushing to the wireless communication device. The post has two ends. One end of the post is joined to the non-telescoping antenna. The other end of the post adapted to electrically connect the non-telescoping antenna to a transceiver of the wireless communication device. The post is journaled in the bushing to permit radial movement of the non-telescoping antenna without unsecuring the bushing from the wireless communication device.

Figure 1:
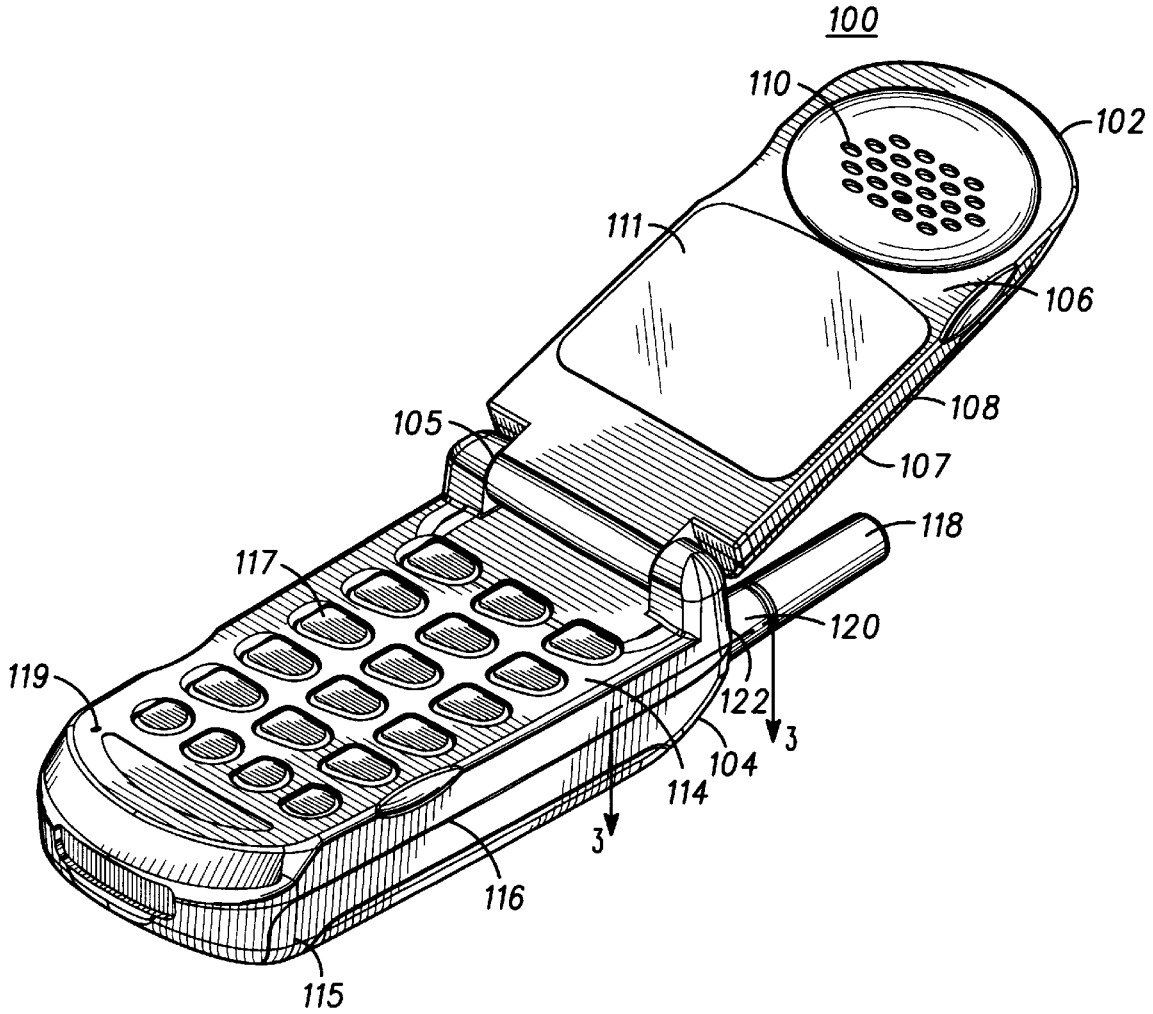
FIG. 1 is a front, bottom and right side perspective view of a wireless communication device employing an antenna assembly.
Figure 3:
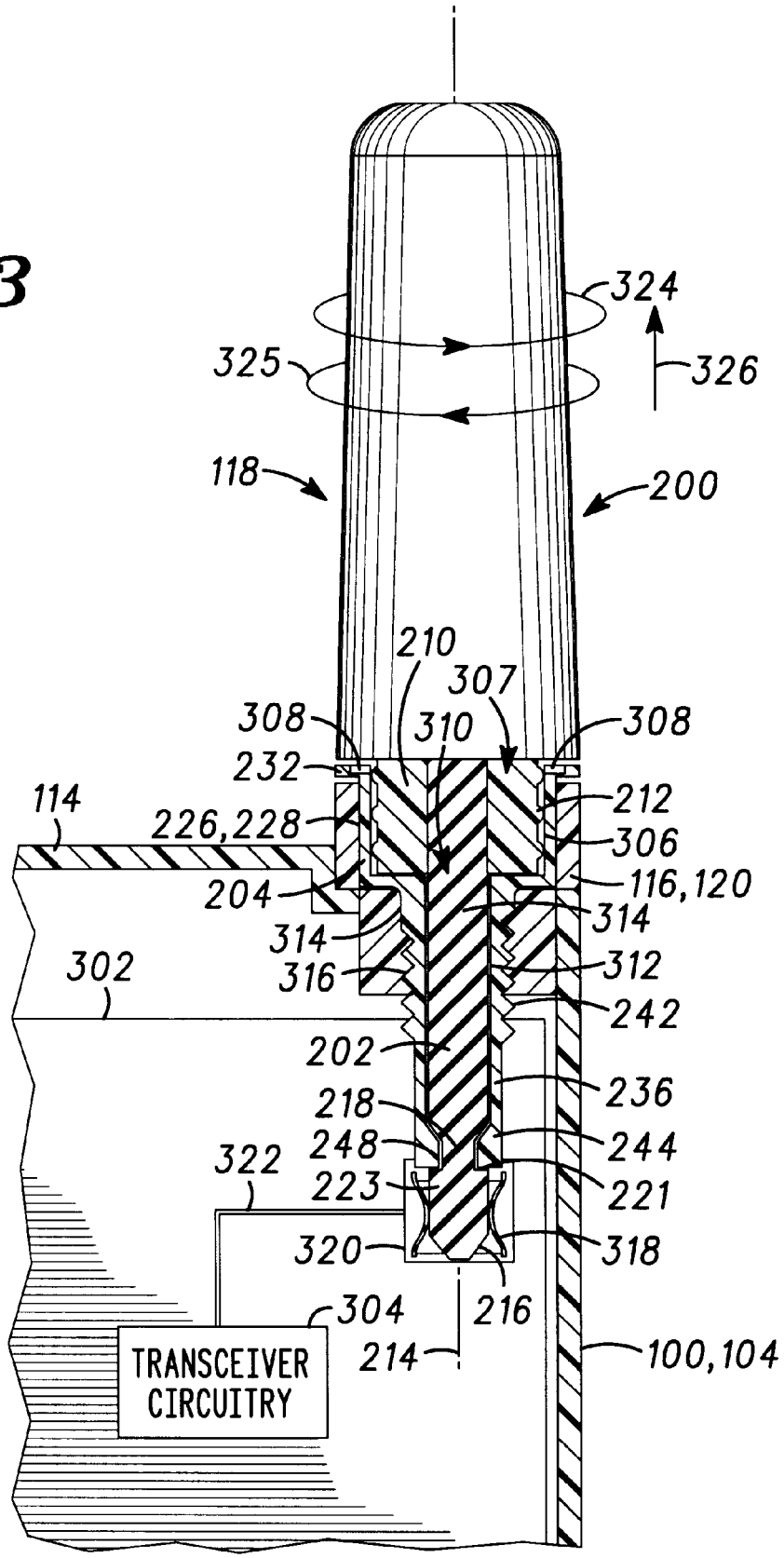
FIG. 3 is an enlarged, partial cross-sectional view of the wireless communication device of FIG. 1 taken across section lines 3—3 in FIG. 1.

A wireless communication device 100, which is shown in FIG. 1 to be a foldable cellular radiotelephone, has top and bottom housings 102 and 104 rotatably joined by a hinge 105. The top housing 102 is formed from front and rear housing portions 106 and 107 mated at junction line 108. A speaker 110 and a display 111 are carried on the front housing portion 106. The bottom housing 104 is formed from front and rear housing portions 114 and 115 mated at junction line 116 to enclose a circuit board 302 with transceiver circuitry 304 as shown in FIG. 3. A keypad 117 of FIG. 1 and a microphone 119 are carried on the front housing portion 114. An antenna assembly 118 is mounted to a boss 120 positioned at a top end 122 of the bottom housing 104.

Figure 2:
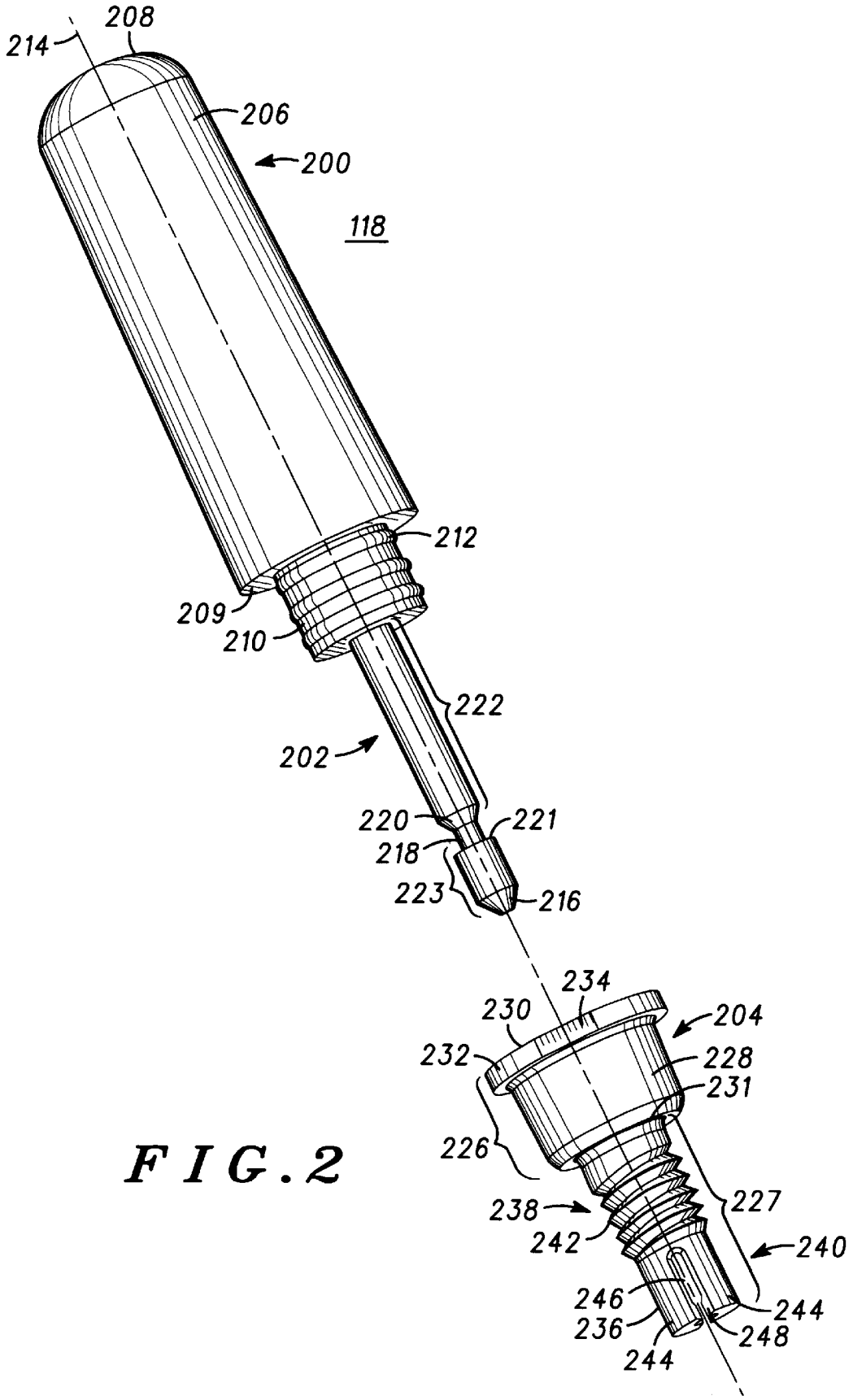
FIG. 2 is an enlarged, exploded perspective view of the antenna assembly of FIG. 1.

The antenna assembly 118 has a non-telescoping antenna 200, a post 202 and a bushing 204, as shown in FIG. 2. The non-telescoping antenna 200 is shown in FIG. 2 as a stubby antenna. The non-telescoping antenna 200 has a radiating and receiving element, such as a metallic helical coil and/or a metallic wire or rod, encased within an overmolded cap 206 formed of a thermoplastic elastomer or other suitable nonconductive material. The cap 206 is substantially cylindrical with a slight taper such that a diameter of end 208 is less than a diameter of end 209. A cylindrical neck 210 of the non-telescoping antenna 200 is integrally joined to the cap 206 at the end 209. The neck 210 has a diameter less than the diameter of the end 209 of the cap 206. The neck 210 has three spaced crush ribs 212 circumscribed thereabout. The ribs 212 are integral to the neck 210 and raised such that a diameter of the neck 210 at the ribs 212 is greater than a diameter of the neck 210 next to the ribs 212.

The post 202 is substantially cylindrical and formed of nickel plated brass or other metallic material. The post 202 has two ends. One end of the post 202 is joined to the non-telescoping antenna 200. The post 202 extends through the neck 210 and into the cap 206 to electrically connect to the radiating and receiving element. The non-telescoping antenna 200 resides concentrically around a longitudinal axis 214 of the post 202. The other end of the post 202 is adapted to electrically connect the non-telescoping antenna 200 to the transceiver circuitry 304 of FIG. 3. FIG. 2 shows that the end of the post 202 distal to the non-telescoping antenna 200 is defined by a chamfered surface 216. The post 202 has a channel 218 located between its ends. The channel 218 circumscribes the post 202 and is bounded by a ramp 220 and a wall 221. The channel 218 separates the post 202 into two cylindrical segments 222 and 223, each with a constant diameter Segment 222 resides between the channel 218 and the neck 210, and segment 223 resides between the channel 218 and the chamfered surface 216.

The bushing 204, which is formed of engineering grade nylon or other suitable material, is defined by integrally joined cup and stem portions 226 and 227. The cup portion 226 is a hollow cylinder defined by an inner surface 306 of FIG. 3 and an outer surface 228 of FIG. 2 extending between ends 230 and 231 The end 230 is defined by a wide opening 307 of FIG. 3 around which a circular rim 232 of FIG. 2 is circumscribed. The rim 232 is flush with the inner surface 306 but extends beyond the outer surface 228. To facilitate assembly and disassembly of the bushing 204 to and from the device 100 of FIG. 1, the rim 232 of FIG. 2 includes a plurality of notches 308 shown in FIG. 3 to be formed in a top edge of the rim 232 and opposing flat edge sections 234 (of which only one is shown in FIG. 2) defined in a side edge of the rim 232. The end 231 is defined by a narrow opening 310 of FIG. 3, which is smaller in diameter than the wide opening 307. The stem portion 227 of FIG. 2, which extends from the end 231 of the cup portion 226, is a hollow cylinder defined by an inner surface 312 of FIG. 3 and an outer surface 228 of FIG. 2. The inner surface 312 is flush with an inner surface of the end 231 of the cup portion 226 that surrounds the narrow opening 310.

The stem portion 227 has two attachment mechanisms 238 and 240. The attachment mechanism 238 is used to secure the bushing 204 to the device 100 of FIG. 1. In the illustrated embodiment, the attachment mechanism 238 of FIG. 2 comprises an integral screw thread 242 spiraled around the outer surface 236 of the stem portion 227 proximate to the cup portion 226. The attachment mechanism 240 is used to join the bushing 204 to the post 202. In the illustrated embodiment, the attachment mechanism 240 comprises opposing spring fingers 244 integrally formed in the inner and outer surfaces 312 and 236 of the stem portion 227 from longitudinal slots 246 extending from an end of the stem portion 227 that is distal to the cup portion 226. The spring fingers 244 have angled feet 248 at the inner surface 312.

Attachment of the antenna assembly 118 to the device 100 of FIG. 1 is accomplished in the following manner, which will be described in conjunction with FIGS. 1–3. First, the bushing 204 is secured to the device 100. To accommodate the bushing 304, the boss 120 provides a cylindrical passage 314 through the front and rear housing portions 114 and 115 of the bottom housing 104. The passage 314 is lined with a reciprocal screw thread 316. The bushing 204 is lowered into the boss 120 and the passage 314 until the screw thread 242 meets the reciprocal screw thread 314. The bushing 204 is rotated clockwise mating the screw thread 242 and the reciprocal screw thread 314, and drawing the bushing 204 further into the device 100. Rotation of the bushing 204 is continued until the cup portion 226 of the bushing 204 is seated in the boss 120 such that a bottom edge of the rim 232 abuts a top edge of the boss 120. The bushing 204 is preferably assembled to the device 100 using an automated screw machine that has a driving tool configured hold the bushing 204 by the plurality of notches 308 of the rim 232. Manual assembly of the bushing 204 to the device 100 may quickly be accomplished via a customized hand tool that engages the plurality of notches 308 or engages the opposing flat edge sections 234 on the side edge of the rim 232.

Once the bushing 204 is assembled to the device 100, the non-telescoping antenna 200 is assembled to the device 100. The non-telescoping antenna 200 is aligned and lowered so that the post 202 passes through the wide and narrow openings 307 and 310 of the cup portion 226 of the bushing 204 and into the stem portion 227 of the bushing 204. The non-telescoping antenna 200 is further lowered pushing the segment 223 of the post 202 past the spring fingers 244, which are outwardly deflected from a rest position as the chamfered surface 216 meets and moves past angled feet 248, and passing the neck 210 through the wide opening 307 and into the cup portion 226. Lowering of the non-telescoping antenna 200 continues until the neck 210 abuts an inner surface of the end 231 of the cup portion 226; the angled feet 248 insert into the channel 218 when the feet 248 pass the segment 223 and are forced into the channel 218 upon return of the spring fingers 244 to the rest position; and the segment 223 of the post 202 is held between a metal spring contact 318 that was deflected by the chamfered surface 216 during lowering. The spring contact 318 is soldered to a metal pad 320 of the circuit board 302 and electrically connected to the transceiver circuitry 304 via connection 322, which may be a subsurface trace. Thus, the radiating and receiving element in the cap 206 of the non-telescoping antenna 200 is electrically connected to the transceiver circuitry 304 via the post 202, the spring contact 318, the pad 320 and the connection 322. The non-telescoping antenna 200 enjoys z-axis, snap-in assembly that is easily accomplished manually or by an automated robot arm.

The antenna assembly 118 is shown assembled to the device 100 in FIG. 3. The post 202 is journaled in the bushing 204 between the ends of the post 202 to permit clockwise and counterclockwise radial movement of the non-telescoping antenna 200 in the direction of arrows 324 and 325, respectively, without disassembling the bushing 204 or the non-telescoping antenna 200 from the device 100. The crush ribs 212 of the neck 210 engage the inner surface 306 of the cup portion 226 to provide enough resistance to prevent the non-telescoping antenna 200 from spinning freely but not enough resistance to back the bushing 204 out of the boss 120. During rotation of the non-telescoping antenna 200 and the post 202, the feet 248 of the spring fingers 244 remain captured in the channel 218 of the post 202 and the segment 223 of the post 202 remains in contact with the spring contact 318 to ensure that the radiating and receiving element of the non-telescoping antenna 200 remains electrically connected to the transceiver circuitry 304. While permitted to rotate, the bushing 204 engages the post 202 to prevent any significant movement of the non-telescoping antenna 200 along the longitudinal axis 214 of the post 202, such as in the event that the non-telescoping antenna 200 is pulled away from the device 100 in the direction of arrow 326. In such an event, bottom edges of the spring fingers 244 would abut against the wall 221 of the channel 218 of the post 202 and prevent detachment of the non-telescoping antenna 200. The antenna assembly 118 is preferably disassembled from the device 100 by engaging the opposing flat edge sections 234 on the side edge of the rim 232 using the aforementioned customized hand tool and rotating the bushing 204 with the tool in a counterclockwise direction causing the bushing 204 to back out of the boss 120.

While particular embodiments have been shown and described, modifications may be made. For example, the attachment mechanism 238 of the bushing 204 could alternately employ arms that snap into channels formed in the boss 120, thereby, providing a complete snap-in solution. Although shown for use with a cellular radiotelephone, the antenna assembly will also find application in cordless radiotelephones, satellite radiotelephones, two-way radios, plug-in transceiver modules, personal digital assistants, and the like. It is therefore intended in the appended claims to cover all such changes and modifications which fall within the true spirit and scope of the invention.

What is claimed is:

1. An antenna assembly for a wireless communication device, the wireless communication device having transceiver circuitry, the antenna assembly comprising:

a non-telescoping antenna;

a bushing including an attachment mechanism to secure the bushing to the wireless communication device;

a post having a first end joined to the non-telescoping antenna and a second end adapted to electrically connect the non-telescoping antenna to the transceiver circuitry, the post journaled in the bushing to permit radial movement of the non-telescoping antenna; and a channel located between the first and second ends of the post to engage the bushing, the channel having at least one abutting side to prevent significant movement of the non-telescoping antenna in at least one direction along a longitudinal axis of the post.

2. The antenna assembly according to claim 1 wherein the bushing includes opposing spring fingers, each of the spring fingers having a foot inserted into the channel.

3. The antenna assembly according to claim 1 wherein the channel is bounded by first and second bounding sides, the first bounding side is a ramp and the second bounding side is a wall.

4. The antenna assembly according to claim 1 wherein the second end of the post is defined by a chamfered surface.

5. The antenna assembly according to claim 1 wherein.:

the bushing includes a cup portion having inner and outer surfaces, and the non-telescoping antenna includes a neck, the neck received in the cup portion, the neck having at least one crush rib, the at least one crush rib engaging the inner wall to provide resistance sufficient to prevent free-spinning radial movement of the non-telescoping antenna.

6. A wireless communication device comprising:

a housing;

a circuit board with transceiver circuitry enclosed in the housing;

a pad connected to the circuit board;

a spring contact mounted to the pad;

a non-telescoping antenna carried on the housing;

a bushing secured to the housing; and a post having a first end joined to the non-telescoping antenna and a second end held in the spring contact, the post journaled in the bushing to permit radial movement of the non-telescoping antenna and prevent significant movement of the non-telescoping antenna along a longitudinal axis of the post; and a channel located between the first and second ends of the post to engage the bushing, the channel having at least one abutting side to prevent significant movement of the non-telescoping antenna in at least one direction along a longitudinal axis of the post.

7. The wireless communication device according to claim 6 wherein:

the bushing includes a cup portion having inner and outer surfaces, and the non-telescoping antenna includes a neck, the neck received in the cup portion, the neck having at least one crush rib, the at least one crush rib engaging the inner wall to provide resistance sufficient to prevent free-spinning radial movement of the non-telescoping antenna.

8. The wireless communication device according to claim 6 wherein the bushing includes opposing spring fingers, each of the spring fingers having a foot inserted into the channel.

9. The wireless communication device according to claim 6 wherein:

the channel is bounded by first and second bounding sides, the first bounding side is a ramp and the second bounding side is a wall, and the second end of the post is defined by a chamfered surface.

* * * * *